United States Patent [19]

Bertino

[11] Patent Number: 4,732,029

[45] Date of Patent: Mar. 22, 1988

[54] ACCIDENT RESCUE TOOL

[76] Inventor: Joseph E. Bertino, 298 Blue Bell Rd., R.D. #1, Vineland, N.J. 08360

[21] Appl. No.: 777,015

[22] Filed: Sep. 17, 1985

[51] Int. Cl.[4] ..... B21D 1/12

[52] U.S. Cl. ..... 72/301; 72/705

[58] Field of Search ..... 72/301, 305, 705; 254/389

[56] References Cited

U.S. PATENT DOCUMENTS

| | | | |
|---|---|---|---|
| 2,691,996 | 10/1954 | McNair | 269/108 |
| 3,891,187 | 6/1975 | Bearden, Jr. | 72/705 |
| 4,030,705 | 6/1977 | Bontrager | 254/389 |

*Primary Examiner*—Lowell A. Larson

*Attorney, Agent, or Firm*—E. Barron Batchelder

[57] ABSTRACT

An accident rescue tool adapted for use in aiding removal of an occupant from a wrecked vehicle which has been badly damaged, or is in a position rendering use of known rescue tools difficult, the tool of the present invention preferably being so designed and operable for conjunctive use with known rescue tools which comprise coactive pivotal arms contactible with components of a wrecked vehicle and having activating means to apply forces to the arms for movement and relative displacement of portions of the vehicle to facilitate access to, and removal of, trapped and/or injured occupants of the vehicle, the present tool more specifically is operable for removing and bending a vehicle steering column to permit removal of a vehicle accident victim in a minimum time interval, the tool which can also be referred to as a rescue roller, consisting of telescopic arms, a roller on a free end of one arm and a fixed roller on the free end of the other arm, the bar combination being rigid in use, adapted for placement in numerous areas of the vehicle and adapted for support of two chains, associated with prior rescue tools with the chains being movably supported by and coactive with the rollers on the arm ends.

8 Claims, 9 Drawing Figures

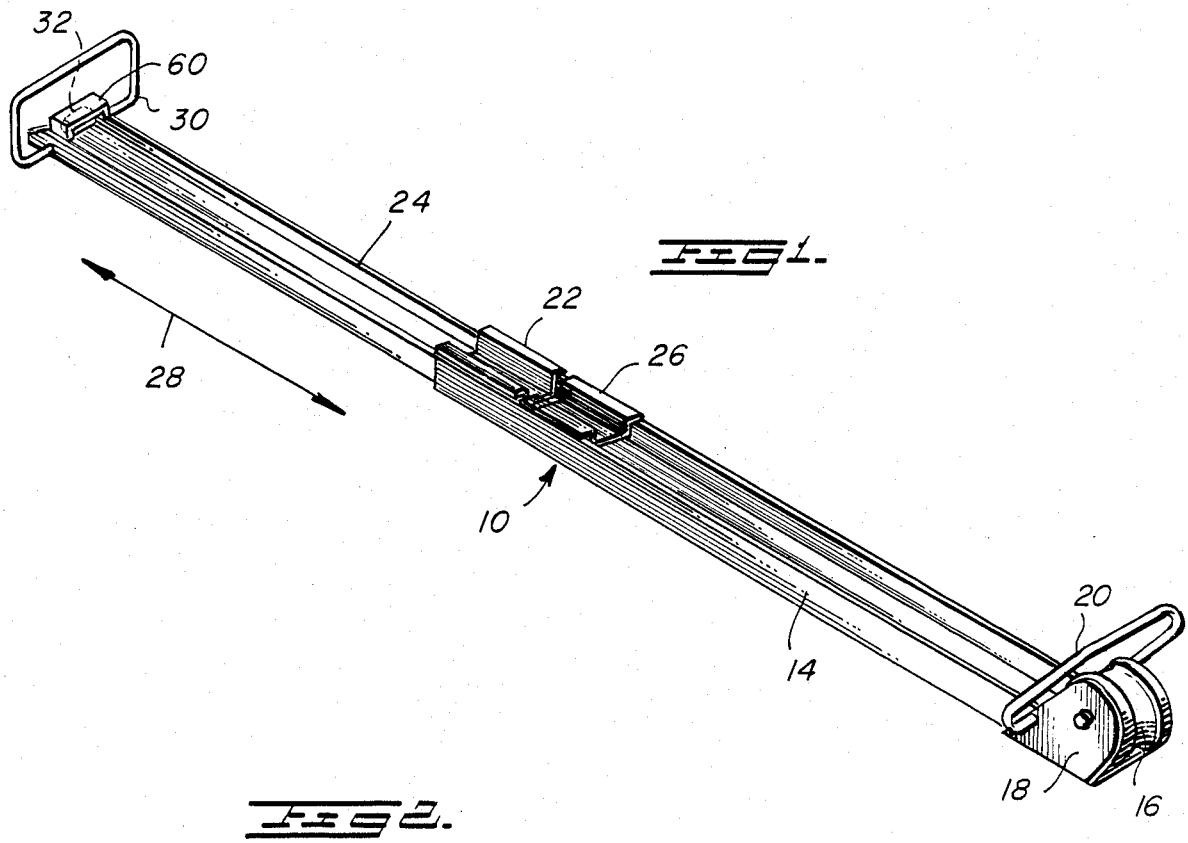
Fig 1.
Fig 2.
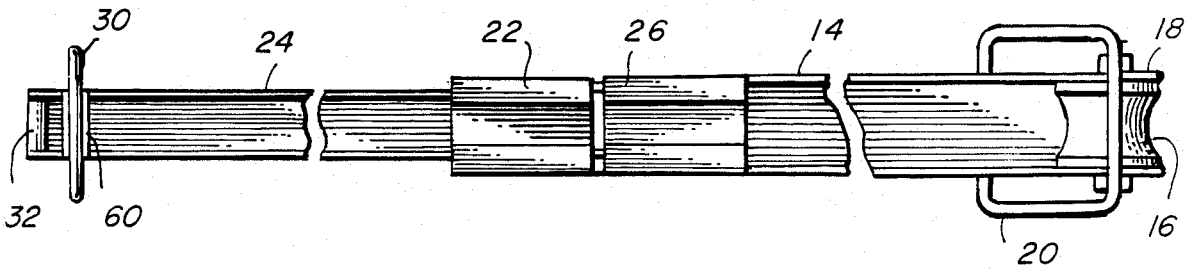
Fig 3.
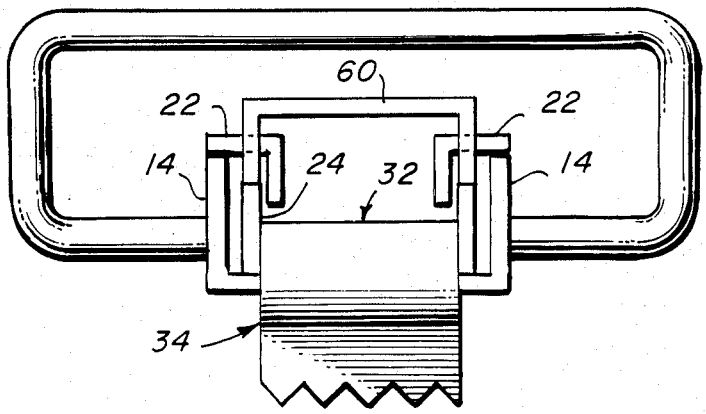

ACCIDENT RESCUE TOOL

BACKGROUND OF THE INVENTION

The present invention relates to an accident rescue tool operable either as a sole unit or preferably for use in conjunction with rescue tools for applying high magnitude push/pull forces.

As is well known, a large number of vehicle accidents occur and due to the speeds of the vehicles and the strength of materials and automotive designs, they can result in one or more of the occupants of the vehicle being trapped inside of the vehicle wreckage.

A well known, a currently existing and used rescue tool is disclosed in U.S. Pat. No. 3,819,153, granted to George H. Hurst on June 25, 1974. Tools such as that disclosed in the patent are normally used by rescue squads called to the scene of an accident, the rescue squads frequently being associated with fire departments. The tool shown in this patent is normally referred to as "JAWS OF LIFE". Another similar rescue tool currently being used is known as a "RESCUE GATOR". Each of these tools, the latter of which is manufactured and sold by WALKER MANUFACTURING COMPANY of Racine, Wisc., and the initially mentioned and patented one being sold by HURST PERFORMANCE, INC., of Warminster, Pa., have been in widespread use and have resulted in many incidences and/or types of accidents and damaged vehicles in providing access to occupants of the wrecked vehicle. Basically, each of these known tools utilize a pair of pivotally interconnected arms or jaws and means for forcibly opening or closing the jaws by hydraulic, pneumatic, electrical or other means, so that when the jaws are applied to various parts of the wrecked vehicle, parts thereof can be either pushed or pulled or divided or separated so that access to the interior of the vehicle is possible.

The actuated force means to pivot the force arms toward or away from one another, as desired, are incorporated in such tools. In other words these known devices are in widespread beneficial use in saving lives of occupants of a vehicle involved in an accident. As is well known, frequently the time interval required to remove an injured person from a wrecked vehicle for treatment on the scene and/or taken to more elaborate medical facilities largely depends upon a time factor for highly or most successful results.

Unfortunately many vehicle accidents result in badly mangled or bent vehicle body portions and also, as is well known, the vehicle driver usually has the steering wheel impacted against the driver's body, and this causes problems and difficulty of freeing the driver from the vehicle. Heretofore, the known devices and/or other tools such as crowbars and the like have been used to remove a door, remove a wheel, or move the car to present a more favorable attitude for use of the tools. The JAWS OF LIFE and RESCUE GATOR, while having a high degree of success in many accident situations, have encountered problems in use due to badly mangled or disposed vehicles. As is well known, frequently this mangling and/or position of vehicle very substantially affects the use of the tools and access to the vehicle occupants.

As mentioned above, very frequently the driver of a vehicle has a steering wheel impacted against him and, as above mentioned, different modes or methods of approach to overcome a difficult situation are encountered. As shown for example, in FIG. 2 of U.S. Pat. No. 3,819,153, a present method of operation using the JAWS OF LIFE tool is to break open the windshield, if this has not already occurred, and utilize the hydraulically operated arms, connected to chains, to pull the steering wheel and column through the windshield opening. Other modes of use are clearly depicted in this patent.

It has been found that frequently the condition or position of the wrecked vehicle is such that the length of time required to move parts of the vehicle and especially an impacted steering wheel, are time consuming. It is also known that the previous devices require a point of attachment of one of the chains, that is the end of a chain, so that the tool can be activated in an appropriate manner.

It is known that under certain circumstances, automobiles and the like, following an accident, are so positioned or in such condition that it is not possible to use the known devices above mentioned to withdraw the vehicle steering column from contact with a trapped victim. As mentioned, normally, the devices as mentioned above and available on the market, are placed on the hood of a vehicle, as shown for example in FIG. 2 of this patent, in use of the tool, if the condition of the hood and its physical placement are such that the JAWS OF LIFE or RESCUE GATOR device can be used.

It is a primary purpose of the present invention to provide a device which overcomes the drawbacks of the known tools and, as an example only, the procedure to remove an impacted steering wheel and column from the driver, using known devices could require, for example, an hour, whereas with the present invention it has been possible to obtain these results in as little as four and one-half—five minutes—a very substantial improvement.

The present accident rescue device is primarily adapted for use with the tools above referred to, i.e., the "JAWS OF LIFE" and "RESCUE GATOR", but permitting a much more facile use under some difficulties encountered in some wrecks. In other words, it is the intention of the present inventor to utilize the previously known devices, but to provide a construction which permits easy and ready adaptation of means for opening or moving parts of vehicles. Broadly, the present device includes a bar portion consisting of two telescopic portions, one having a hook on the end thereof which is attachable to, for example, the hinge mounting post of the vehicle body or other substantial body portion and then, by use of chains, connectable thereto are so operable as to serve the function of withdrawing the steering column up or laterally from contact with the victim. It has been found that the structure of the present invention not only serves as an extension, but also can be so used as to provide a point of attachment which is sufficiently strong to readily facilly perform its function. The present accident rescue device very substantially increases the effectiveness and consequently a substantial decrease in time involved to remove retaining contact between the steering wheel and column with the driver or occupant of the vehicle. The present device can be so connected to various portions of the vehicle as to permit a sideways movement of the steering column, a vertical lifting of the same for removal through the windshield and/or in positions of difficult use dependent upon the condition and positioning of the vehicle. It is also to be noted that the present invention can be utilized for the purpose of pulling a seat back to increase the ease of operation to remove the steering column either through the front, up, or to a side.

The present invention will be described hereinafter in greater detail with reference to the accompanying drawings in which FIG. 1 is a perspective view of the apparatus of the present invention in extended condition;

FIG. 2 is an enlarged fragmentary top plan view of the invention;

FIG. 3 is a still further or greatly enlarged end elevational view of FIG. 2 looking at the lefthand end thereof;

Figure 4:
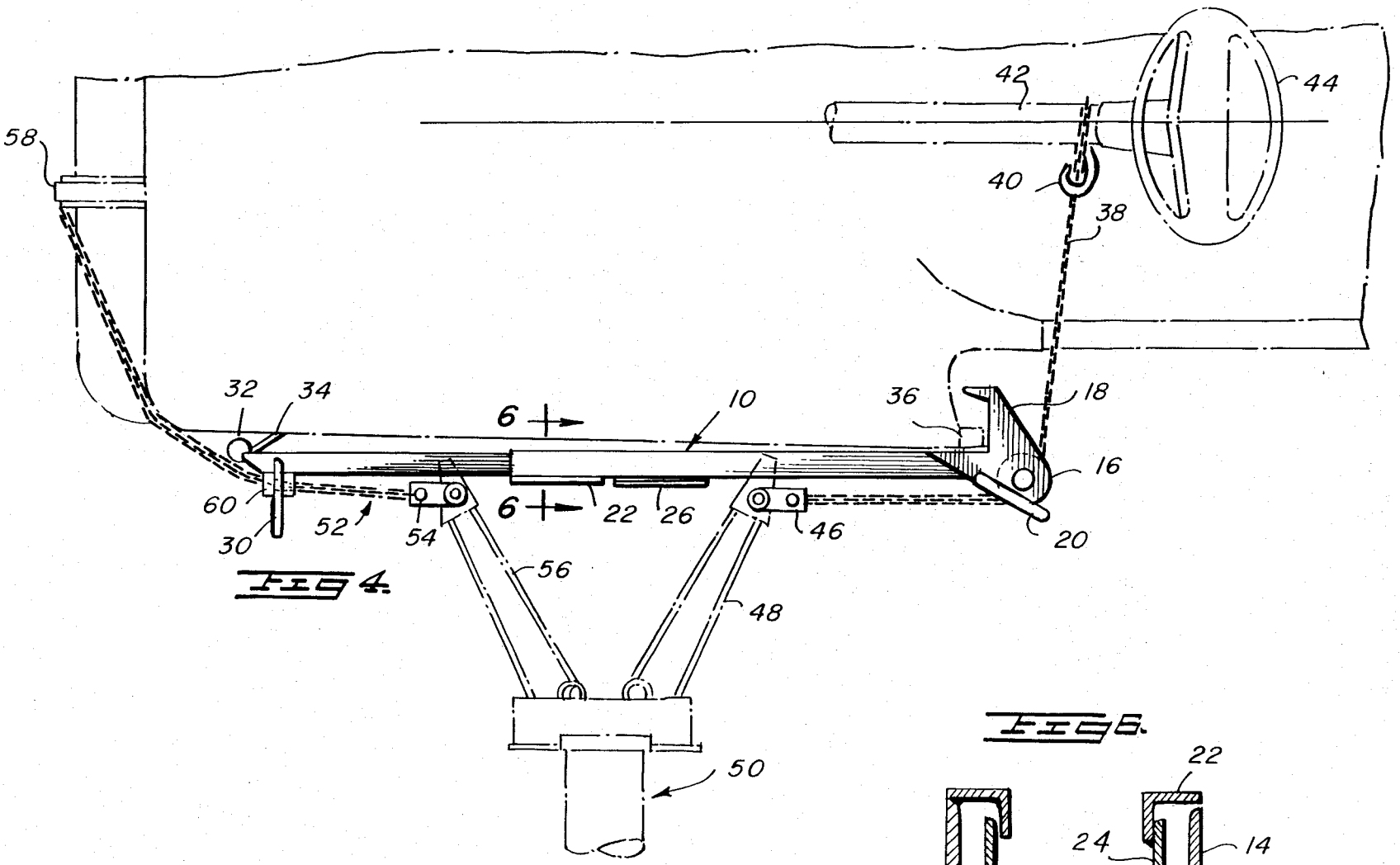
Figure 6:
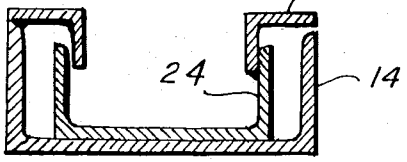
Figure 5:
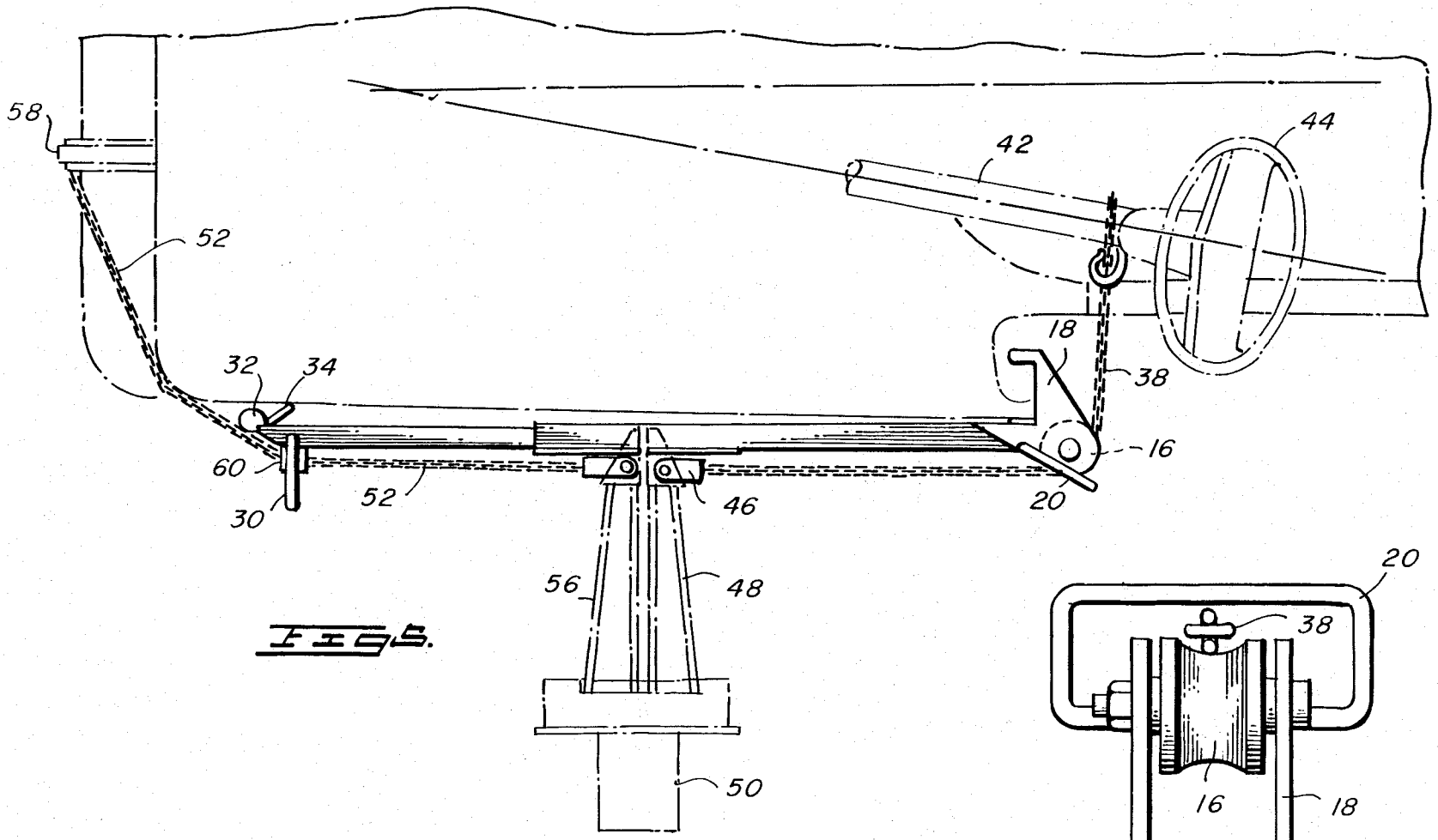
Figure 7:
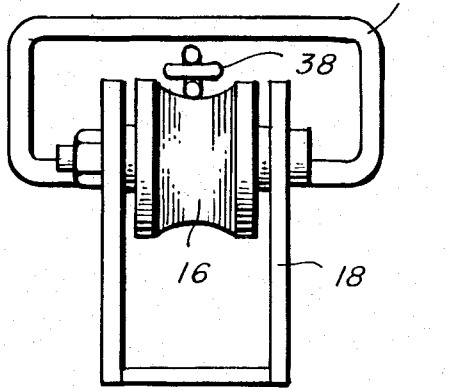

FIG. 4 is a plan view of the present invention as applied to an automobile, shown in phantom lines, and in association with a known rescue tool as shown in U.S. Pat. No. 3,819,153, the latter tool of the prior art likewise being shown in phantom lines, as also is a portion of the vehicle and its steering wheel and column;

FIG. 5 is a view similar to FIG. 4 and showing the present invention in association with an automobile, and the rescue tool of FIG. 4 in an actuated position for removal of the steering column and wheel, its removal movement or condition being directed sideways;

FIG. 6 is a transverse sectional view, taken on line 6—6 of FIG. 4;

FIG. 7 is an enlarged righthand end view of the invention seen in FIG. 2, showing a movable or rotatable roller about which a chain can be moved in an unhindered condition, and adapted for a hook end on which is mounted a vertical frame member, the opposite end utilizing a fixed so-called roller for chain guidance, with its end affixed to any vehicle member having sufficient strength for its operation.

Figure 8:
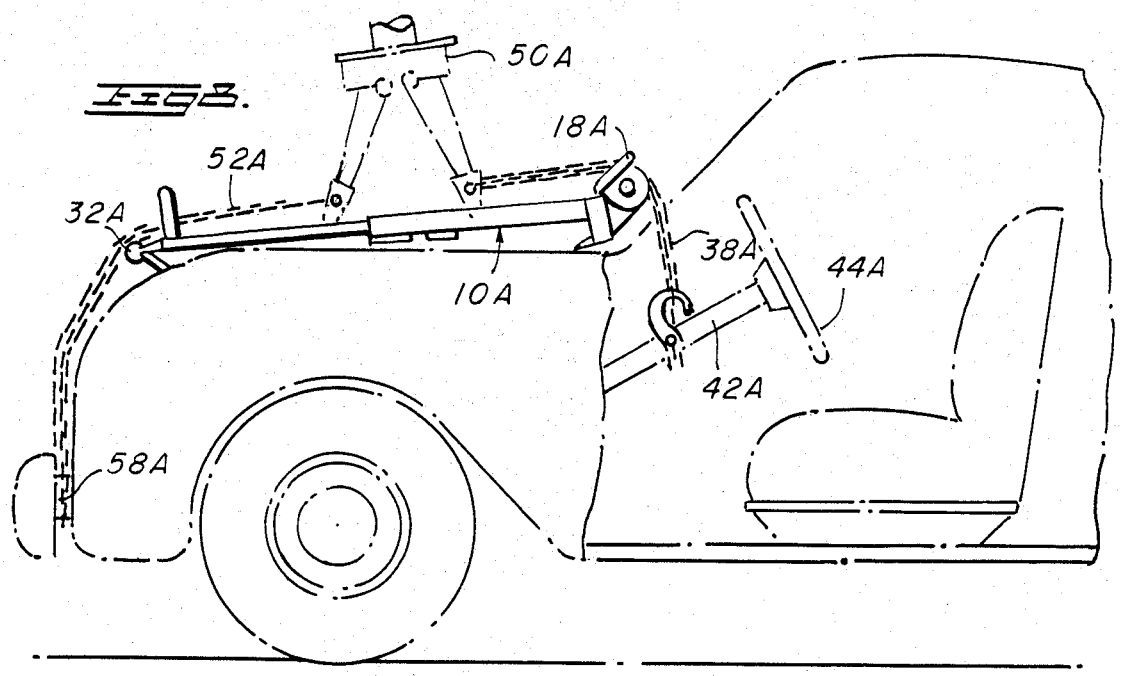
Figure 9:
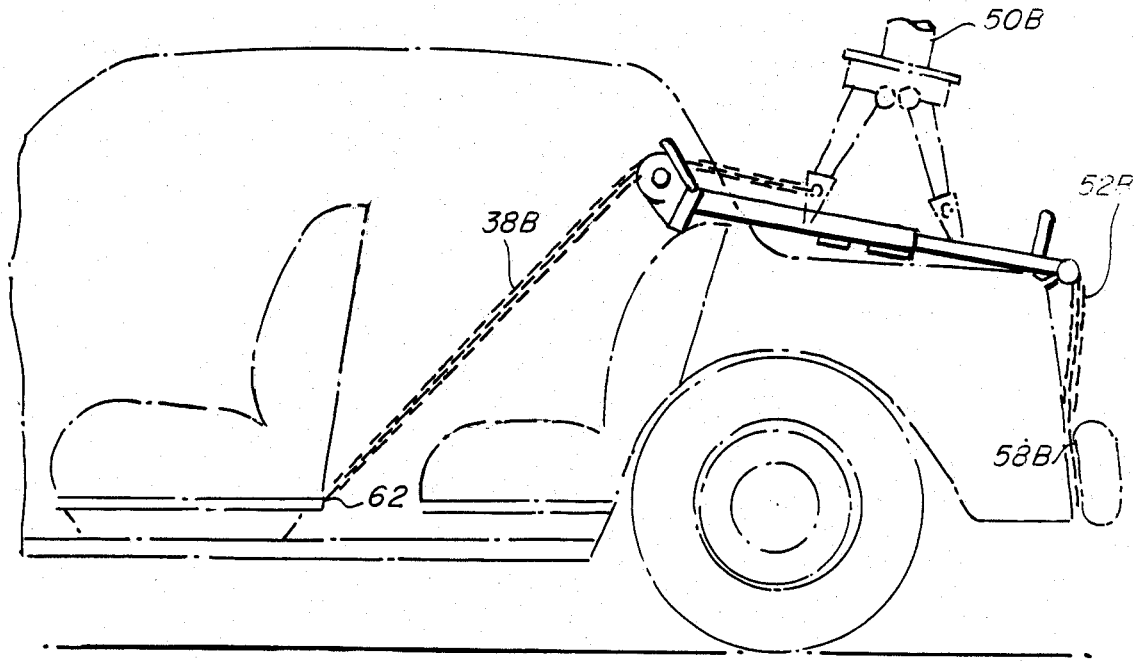

FIG. 8 is a side elevational view of the compound tool, as applied around the steering column for upward turning and removal thereof, with the present tool being mounted above and engaged on the top of a hood; and FIG. 9 is a fragmentary vertical view showing the combined rescue tool, including the known prior instrument and the present invention attached so as to move the driver's seat to the rear.

DESCRIPTION OF THE PREFERRED EMBODIMENTS

Referring now in more detail to the drawings, the apparatus of the invention broadly includes a bar generally designated 10 which consists of a first channel shaped portion referred to as an outer bar 14 and functionally referred to as the roller end, having a roller 16 rotatably mounted on an angularly disposed hook member 18 better seen in FIG. 5. The purpose of this hook end is to permit that bar end of the present invention to be readily attached to and held by a substantial strength vehicle member, there usually being a substantial number of the same and having availability irregardless of vehicle body condition and/or position. A handling handle 20 is provided and attached to the hook end 18. At the opposite end of outer bar 14, a flanged abutment or stop member 22 is fixedly mounted and which also confines a coactive bar and provides rigidity.

A second, inner or telescopic bar member 24 is slidably disposed within the channel of outer bar 14. The inner end of this bar 24 is also provided with a flanged abutment 26, the two abutments serving as limit stop members and to provide a combined rigidity. The relative displacement of the inner bar 24 with respect to the outer bar 14 is depicted by the double ended arrow 28. A handle 30 is mounted for co-action with the handle 20. A so-called fixed roll 32 is positioned at the outer terminal end and is adapted for the chain, later described, to pass thereover. This fixed roll 32 has at its ultimate end a serrated portion 34 which serves for engagement or penetration in a body portion of the vehicle. It is pointed out that the opposite ends of the composite bar must be supported or connected with a vehicle member in order for the device to function operatively.

Referring now to FIG. 4, the composite bar 10 is so mounted that the hook end is placed in operative position around a vertical frame member 36. A first chain end 38 having a hook 40 at the terminal free end thereof is operatively connected on or around the steering column 42 of the vehicle. A steering wheel is shown at 44. As mentioned hereinbefore, normally the steering column 42 and/or wheel 44 are forcefully impacted against the driver and the function of the device is to move the column 42 and wheel 44 from confining engagement or contact and, in the arrangement shown in FIG. 4, the steering column is to be moved sideways from the position shown in FIG. 4 to that shown in FIG. 5, thereby freeing the driver of the vehicle. The chain 38 passes around the roller 16 and at its inner end 46 is pivotally attached to one arm 48 of a JAWS OF LIFE, generally indicated at 50, reference being made to U.S. Pat. No. 3,819,153 for details thereof. A second chain end 52 is pivotally attached at 54 to arm 56. This chain end 52 passes around the fixed roller 32 and the end thereof is engaged with a bumper bracket or the like 58 or some similar frame member of strength. A tail guard 60, consisting of an inverted channel, serves to prevent the chain from jumping out of bar 24.

When so mounted as seen in FIG. 4, the JAWS OF LIFE 50 are energized and the two bar portions move into a shortened arrangement and thereby applying a tension on the chain ends, and continued movement of the arms 48, 56, will serve to move the steering column 42 and wheel 44 to the position shown in FIG. 5, wherein the arms are shown in a retracted position. This movement, as can be readily understood, will free the occupant from impacted contact from the column and wheel. During this shortening action, the two arms of the present invention will function automatically into the position shown in FIG. 5. This is the end desired relationship of the embodiment in one use form of action.

Reference is now made to FIG. 8. In this instance the composite bar 10A is positioned on or above the hood with the hooked end 18A in engagement with the frame body, such as surrounding the windshield. The chain portion 38A is again operatively engaged with steering column 42A with its free end attached to one arm of the JAWS OF LIFE 50A. The chain 52A is operatively connected to the other arm of the JAWS OF LIFE and has its end engaged about the bumper bracket as at 58A. In this arrangement, when the JAWS OF LIFE 50A is activated, the chains will raise the steering column and steering wheel 44A upwardly, to free the driver from the restraining contact thereof.

In FIG. 9 the JAWS OF LIFE 50B is operatively interconnected with chain ends 38B which in turn is affixed to the lower edge or end of the seat indicated at 62 and the opposite of second chain end 52B is attached to a bumper bracket or other frame portion at 58B. Operatively in the connection embodiment shown in FIG. 9, the arrangement will serve to rearwardly move the seat and this in turn will again free binding contact of the steering column and wheel with the driver of the vehicle.

It will readily appear from the foregoing that the present device serves to provide a smooth operation of the chains of a device such as JAWS OF LIFE or RESCUE GATOR with the ends of the chains being attached to a strong, fixed portion of the auto chassis on one end and this permits components or parts of the vehicle to be desirably moved and/or removed. The device can be said to have the purpose of permitting spanning of areas or portions of a vehicle, and in conjunction with known devices to interconnect strong and fixed parts of the vehicle for movement thereof. The rotatable wheel and fixed wheel serve to facilitate this function and, as pointed out above, the telescopic arms of the invention provide a rigid member which is adjustable and can be mounted operatively against different selected portions of the vehicle so that the chains can serve their desired function. An additional manner of use of the invention is to place one end of one chain or one arm of the JAWS OF LIFE to a fixed exterior member and with the opposite end being selectively attached to a portion of the vehicle to be affected.

From the foregoing embodiment description and the drawing figures, the function and operation of the present invention will be readily understood.

Manifestly, minor changes in details of construction and arrangement can take place without departing from the spirit and scope of the invention as defined in and limited solely by the appended claims.

I claim:

1. An accident rescue tool adapted for aiding removal of an occupant from a wrecked vehicle which has been badly damaged, or is in a position rendering use of known rescue tools difficult, said tool including a first bar member and a second bar member telescopically interactive and providing a rigid variable length overall bar arm, one free end of one said bar member having a hook-shaped member affixed thereto and a rotatably mounted roller, a first chain passing about said roller and being affixed to a vehicle component, the other of said bar members having a fixed roll at the free end thereof and a terminating serrated end thereon for attachment to a vehicle component, a chain passing around said fixed roller and having its free end attached to a rigid vehicle component, the respective inner end of said chains being attachable to operating means for drawing the respective chains toward one another in a manner to telescope said bar and in conjunction with said chains to move a component of the vehicle with respect thereto and to an occupant therof.

2. An accident rescue tool as claimed in claim 1, and wherein the force applying means comprises two pivotally mounted arms interconnected at their free end with the free ends of the respective chains, the arms for applying said force upon pivoting thereof to closed position serving to shorten the distance between said free chain ends resulting in a telescopic action of the two bar portions and resulting in movement of vehicle component parts.

3. An accident rescue tool as claimed in claim 2, said fixed roll having a terminal end, said terminal end being serrated and adapted for fixed penetration with and within a strong vehicle component.

4. An accident rescue tool as claimed in claim 3, and including handles at the outer ends of each of said telescopically interactive bar members to permit handling and placement of the tool against spaced strong components of said vehicle to permit functioning thereof.

5. An accident rescue tool as claimed in claim 4, the ends of the telescopically interactive bar members having flanged abutment members affixed thereto in overlapping relationship and serving to rigidify the bar components and to limit inward longitudinal movement with respect to one another.

6. An accident rescue tool for use in forcibly moving vehicle steering wheel columns from restraining position against an occupant of a badly damaged vehicle comprising two relatively telescopic arms, a roller on a free end of one said arm and a fixed roller on the free end of the other said arm, the bar combination consisting of the telescopic arms being in rigid positionment with respect to one another and adapted for placement in selective fixed areas of the vehicle, said arms and said rollers being adapted for supporting two chains, and means for telescopically moving said arms with respect to one another for shortening the distance between the free ends of said chains, the shortening of the distance between the ends serving to move components of the vehicle to free a vehicle occupant from being restrained by a said vehicle component.

7. An accident rescue tool as claimed in claim 6, and including pivotally mounted members having ends thereof interconnected with inner free ends of said chains and means for applying forces to pivot the pivotally interactive bar members by application of forces and the resultant movement serving to draw the free chain ends toward one another.

8. An accident rescue tool adapted for use in aiding removal of an occupant from a wrecked vehicle having a badly damaged condition or with the vehicle in a position rendering use of rescue tools difficult, the rescue tool being operable for conjuctive use with known rescue tools which comprise co-active pivotal arms contactable with components of a wrecked vehicle and having activating means to apply forces to the arms for movement and relative displacement of portions of the vehicle to facilitate access to, and removal of, restrained occupants of the vehicle, said rescue tool more specifically being operable for moving a vehicle steering column to permit removal of a vehicle accident victim in a minimum time interval, the rescue tool consisting of telescoping arm members, a roller on an end of one said arm member, and a fixed roller on an end of the other said arm member, said arm members conjointly constituting a rigid bar combination of variable length adapted for placement in numerous areas of a vehicle and adapted for support of two chains, respectfully associated with said co-active pivotal arms with the chains being movably supported by and co-active with the rollers on the arm member ends.

* * * * *